US006322020B1

(12) United States Patent
Reisinger

(10) Patent No.: US 6,322,020 B1
(45) Date of Patent: Nov. 27, 2001

(54) REEL WINDING DEVICE AND PROCESS HAVING CUTTER HOLDER MOVABLE IN ACCORDANCE WITH A WOUND ROLL DIAMETER

(75) Inventor: Franz Reisinger, Wald (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/482,013

(22) Filed: Jan. 13, 2000

(30) Foreign Application Priority Data

Jan. 14, 1999 (DE) ..... 199 01 112

(51) Int. Cl.[7] ..... B65H 35/04

(52) U.S. Cl. ..... 242/527.3; 242/541.7; 242/542

(58) Field of Search ..... 242/527, 527.3, 242/541.1, 541.7, 542

(56) References Cited

U.S. PATENT DOCUMENTS

| | | | | |
|---|---|---|---|---|
| 4,345,722 | | 8/1982 | Kuhn . | |
| 4,368,855 | | 1/1983 | Schönmeier et al. . | |
| 4,516,735 | | 5/1985 | Snygg . | |
| 5,310,130 | * | 5/1994 | Wieland et al. | 242/527 |
| 5,505,403 | * | 4/1996 | Rudaskoski | 242/527.3 |
| 5,639,045 | | 6/1997 | Dörfel . | |
| 5,653,399 | | 8/1997 | Koutonen et al. . | |
| 5,848,760 | * | 12/1998 | Kruger et al. | 242/527 |

FOREIGN PATENT DOCUMENTS

| | | | |
|---|---|---|---|
| 2010072 | * | 9/1971 | (DE) . |
| 2909736 | * | 9/1980 | (DE) . |
| 460395 | * | 12/1991 | (EP) . |
| 540896 | * | 5/1993 | (EP) . |
| 529407 | * | 12/1994 | (EP) . |
| 0716997 | | 6/1996 | (EP) . |
| 60232358 | * | 11/1985 | (JP) . |

OTHER PUBLICATIONS

Patent Abstract of Japan, M–469, vol. 10, No. 9 (Apr. 12, 1986).*

* cited by examiner

*Primary Examiner*—William A. Rivera
(74) *Attorney, Agent, or Firm*—Greenblum & Bernstein, P.L.C.

(57) ABSTRACT

Apparatus and process for winding a web onto a wound reel. The apparatus includes at least one king roll, at least one roll support unit, and a winding bed formed by the at least one king roll and the at least one roll support unit. A separating device includes a cutter located on a displaceable cutter holder, and support arms are swivelably coupled around a rotational axis of the at least one king roll. The support arms are coupled to the cutter holder. The process includes rotating the at least one king roll, such that the wind reel is rotatably driven, moving the cutter toward a gap between the at least one king roll and the at least one roll support unit, and rotating the cutter holder around the rotational axis of the at least one king roll. The process also includes pressing, with the cutter holder, the web against an outer circumference of the at least one king roll, and ejecting the reel from the winding bed, such that the web is separated along the cutter.

28 Claims, 2 Drawing Sheets

1
2
3
4
5
6
7
8
9
10
11
12
13
14
15
16
17
18
19
20
21
22
23

2
8
19
17
12
23
22
16
13
25
24
4
A
15
14
5
21
A
26
3

REEL WINDING DEVICE AND PROCESS HAVING CUTTER HOLDER MOVABLE IN ACCORDANCE WITH A WOUND ROLL DIAMETER

CROSS-REFERENCE TO RELATED APPLICATIONS

The present application claims priority under 35 U.S.C. §119 of German Patent Application No. 199 01 112.5, filed on Jan. 14, 1999, the disclosure of which is expressly incorporated by reference herein in its entirety.

BACKGROUND OF THE INVENTION

1. Field of the Invention

The present invention relates to a reel winding device and process for winding a web onto a wound reel. The reel winding device includes a winding bed formed by at least one king roll and at least one additional reel support, and a separating device having a cutter arranged on a cutter holder that is displaceable between an operating position and a normal position.

2. Discussion of Background Information

A reel winding device is known, e.g., from EP 0 529 407 B1, that includes a winding bed formed by two king rolls. A separating device, that is retracted into the winding bed from below, includes a movable cutter holder which can be swiveled. In this manner, the cutter, which is positioned on one end of the movable cutter holder, approaches a king roll, and the other end of the cutter holder is supported against the other king roll. When the wound reel is ejected from the winding bed, the web is torn off at a cutting edge of the cutter.

A further development in reel winding devices is disclosed, e.g., in EP 0 540 896 A1. The movement of the cutter holder, which is intended to assume a similar position upon cutting, is controlled by alternative devices to enable the web to be cut when the wound reel assumes a smaller diameter and thus sinks deeper into the winding bed.

Further, EP 0 460 395 B1, for example, discloses a winding device having a separating device arranged beneath the king roll. The cutter is fastened to a cutter holder, and the cutter holder is connected to a lever rod which assures that the cutter can describe the path of an arc as it moves into the winding bed. In the operating position, the cutter holder, which exhibits a curvature, rests against the king roll.

Such winding devices serve to wind webs, e.g., paper or cardboard, onto a wound reel. The webs supplied often have a greater length than a single wound reel can accept and/or are continuous. Thus, it is sometimes necessary to split the web in a direction crosswise to its longitudinal direction, remove the "full" wound reel, and insert a new winding core. However, separation of the web is not always actually achieved by a cutting process. Rather, the web is often merely torn off over the cutting edge of the cutter. The cutting edge is therefore often notched or constructed with a row of nibs, so that the web is first perforated and then torn off along the perforation line. This process, nevertheless, is described as "cutting." The quality of the cut in this process is dependent on, among other factors, the position and angular orientation of the cutter and the tear resistance of the web. If the cutter is relatively dull, e.g., after somewhat lengthy use, and if the web being wound has a high tear resistance, e.g., a cardboard web, incorrect positioning of the cutter can result in failure to achieve separation. As a result, a rather lengthy interruption of the winding process can be caused because of the necessity of reworking by hand. For the aforementioned known devices, an operating position for the cutter is position which has proven to be sufficient for most applications. As a result, there are still situations in which the separation process is not satisfactory.

SUMMARY OF THE INVENTION

The present invention generally improves the separation process, and provides, in addition to the reel winding device of the type generally discussed, that the cutter holder is fastened to support arms which can be swiveled about a rotational axis of the king roll.

In this manner, an operating position of the cutter can be selected with a relatively high degree of freedom. For example, the type of material to be separated can be taken into consideration. Further, it is relatively simple to control the motion of the cutter because the cutter can be mounted to describe a circular path around the rotational axis of the king roll. Here, it may be especially preferable for the cutter holder to be fastened to the support arms in an articulated manner. Further, at least one support arm can include an auxiliary drive in which an angle between the support arm and the cutter holder may be adjustable. In accordance with the instant invention, it may be possible to maintain a distance between the surface of the king roll and the cutter by positioning the cutter. In this way, damage to the surface of the king roll which can be caused by the cutter can be avoided. In a cutting or operating position, the cutter can be brought near to the king roll, so that the cutter holder lies on the web and holds the web against the king roll. While the wound reel is ejected, the cutter holder is held securely by the auxiliary drive so that the cutter is supported across the width of the winding device with relatively high stability. As a result, a higher load capacity under the forces which arise. In spite of relatively few movable parts, it is possible to position the cutter at the optimal position by the combined action of the support arms and the auxiliary drive.

The cutter holder can preferably include a curvature which is matched to the curvature of the circumference of the king roll. In this manner, the web can be held flat on the surface of the king roll when the separation process is performed. Consequently, there is a relatively large holding force available for the web, even if the contact force of the cutter holder against the king roll is limited. However, if the web is securely held, the weight of the wound reel is sufficient in most cases to effect separation, even when the cutting edge of the cutter is dull. In addition, the cutter holder supports itself in this configuration by its curvature and by the positioning of the cutter holder at the king roll.

An auxiliary drive can preferably be coupled to the cutter holder in a region of the end of the curvature. The region of the end of the curvature can extend on both sides of a transition of the curve to an uncurved portion of the cutter holder. The optimal position can be easily determined through several attempts, i.e., empirically, by one skilled in the art. If the auxiliary drive is coupled to the end region of the cutter holder, it is possible to apply a certain initial tension to the circumference of the king roll, thereby increasing the stability of the cutter holder during the cutting process.

At least one support arm can be connected to a drive to which a control mechanism is connected for adjusting a swivel angle as a function of the diameter of the wound reel. The swivel angle through which the support arm sweeps, starting from the normal position, is the primary standard of measure for attaining the operating position. The smaller the diameter of the wound reel, for example, the smaller the swivel angle can be, and the shorter the distance the support arm must travel in order to position the cutter in the operating position. The diameter of the wound reel can be determined relatively easily, e.g., a control mechanism can be supplied with a Boolean operation table, which assigns a specific swivel angle to each diameter region.

The auxiliary drive and/or the drive may be preferably constructed as linear drives. For example, piston-cylinder drives which are hydraulically or pneumatically driven may be used. Thus, a relatively sensitive positioning of the cutter in the operating position can be achieved.

The drive can preferably contact the support arm at the same position at which the cutter holder is fastened. In this manner, a quasi-translation-free transmission of motion from the drive to the cutter holder can be obtained. Only a single articulated connection is required, and the cutter holder is not subjected to a momentum force by the drive.

The cutter holder can preferably include a reinforcement profile at its end opposite from the cutter. This reinforcement profile serves to, among other things, prevent deflection of the cutter holder, and thus, to prevent deflection of the cutter during the cutting or separation process. Moreover, the cutter holder can be supported by the reinforcement profile.

The reinforcement profile may preferably include a support wall that supports the cutter holder between the winding bed and the connection to the support arm. Thus, an additional element is provided to prevent, or least to make more difficult, deflection of the cutter holder.

The support wall preferably has a concave path which is fitted to the reel support. In this manner, the point of contact of the support wall against the cutter holder may be displaced even farther in the direction of the winding bed.

The present invention is directed to an apparatus for winding a web onto a wound reel that includes at least one king roll, at least one roll support unit, and a winding bed formed by the at least one king roll and the at least one roll support unit. A separating device includes a cutter located on a displaceable cutter holder, and support arms are swivelably coupled around a rotational axis of the at least one king roll. The support arms are coupled to the cutter holder.

According to a feature of the invention, the cutter holder can be movable between an operating position and a normal position.

In accordance with another feature of the present invention, the cutter holder may be coupled to the support arms in an articulated manner, and the apparatus can further include an auxiliary drive arranged to couple at least one of the support arms to the cutter holder, and to angularly adjust the cutter holder relative to the at least one support arm.

The cutter holder can include a curved portion having a curvature adapted to matched to a curvature of a circumference of the king roll. Further, an auxiliary drive can be coupled to the cutter holder in a region of an end of the curved portion.

The apparatus can also include a drive coupled to at least one of the support arms, and a control mechanism coupled to the drive to adjust a swivel angle of the cutter holder in accordance with a diameter of the wound reel.

Further, an auxiliary drive can be coupled to at least one of the support arms, and a drive can be coupled to at least one of the support arms. At least one of the auxiliary drive and the drive can include a linear drive.

According to still another feature of the instant invention, the drive can be coupled to the at least one support arm at a position at which the cutter holder is coupled to the at least one support arm.

In accordance with a further feature of the present invention, the cutter holder can include a reinforcement profile located at an end opposite from the cutter. The reinforcement profile can include a support wall positioned to support the cutter holder between the cutter and the at least one support arm. Moreover, the support wall can include a concave portion adapted to a contour of the at least one roll support unit.

According to still another feature of the invention, the web can be composed of one of a paper and a cardboard web.

In accordance with a still further feature of the invention, the at least one roll support unit can include at least one additional king roll.

The present invention is directed to an apparatus for winding a web onto a wound reel that includes at least one king roll, at least one roll support unit, and a winding bed formed by the at least one king roll and the at least one roll support unit. A separating device includes a cutter located on a displaceable cutter holder, and support arms are swivelably coupled around a rotational axis of the at least one king roll. The support arms are coupled to the cutter holder in an articulated manner. A drive is arranged to rotatably displace the cutter holder around the rotational axis of the at least one king roll, and an auxiliary drive is arranged to couple at least one of the support arms to the cutter holder, and to rotatably pivot the cutter holder relative to the at least one support arm.

In accordance with a feature of the present invention, the cutter holder can include a curved portion having a curvature adapted to matched to a curvature of a circumference of the king roll, and the auxiliary drive can be coupled to the cutter holder in a region of an end of the curved portion.

A control mechanism may be coupled to the drive to adjust a swivel angle of the cutter holder around the rotational axis of the at least one king roll.

The present invention is also directed to a process for separating a web in an apparatus that includes at least one king roll, at least one roll support unit, a winding bed formed by the at least one king roll and the at least one roll support unit, a separating device having a cutter located on a displaceable cutter holder, support arms swivelably coupled around a rotational axis of the at least one king roll, and the support arms coupled to the cutter holder. The process includes rotating the at least one king roll, such that the wind reel is rotatably driven, moving the cutter toward a gap between the at least one king roll and the at least one roll support unit, and rotating the cutter holder around the rotational axis of the at least one king roll. The process also includes pressing, with the cutter holder, the web against an outer circumference of the at least one king roll, and ejecting the reel from the winding bed, such that the web is separated along the cutter.

According to another feature of the invention, the rotating of the cutter holder moves the cutter through the gap between the at least one king roll and the at least one roll support unit.

In accordance with yet another feature of the present invention, the rotating of the cutter holder moves the cutter into a winding bed region.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
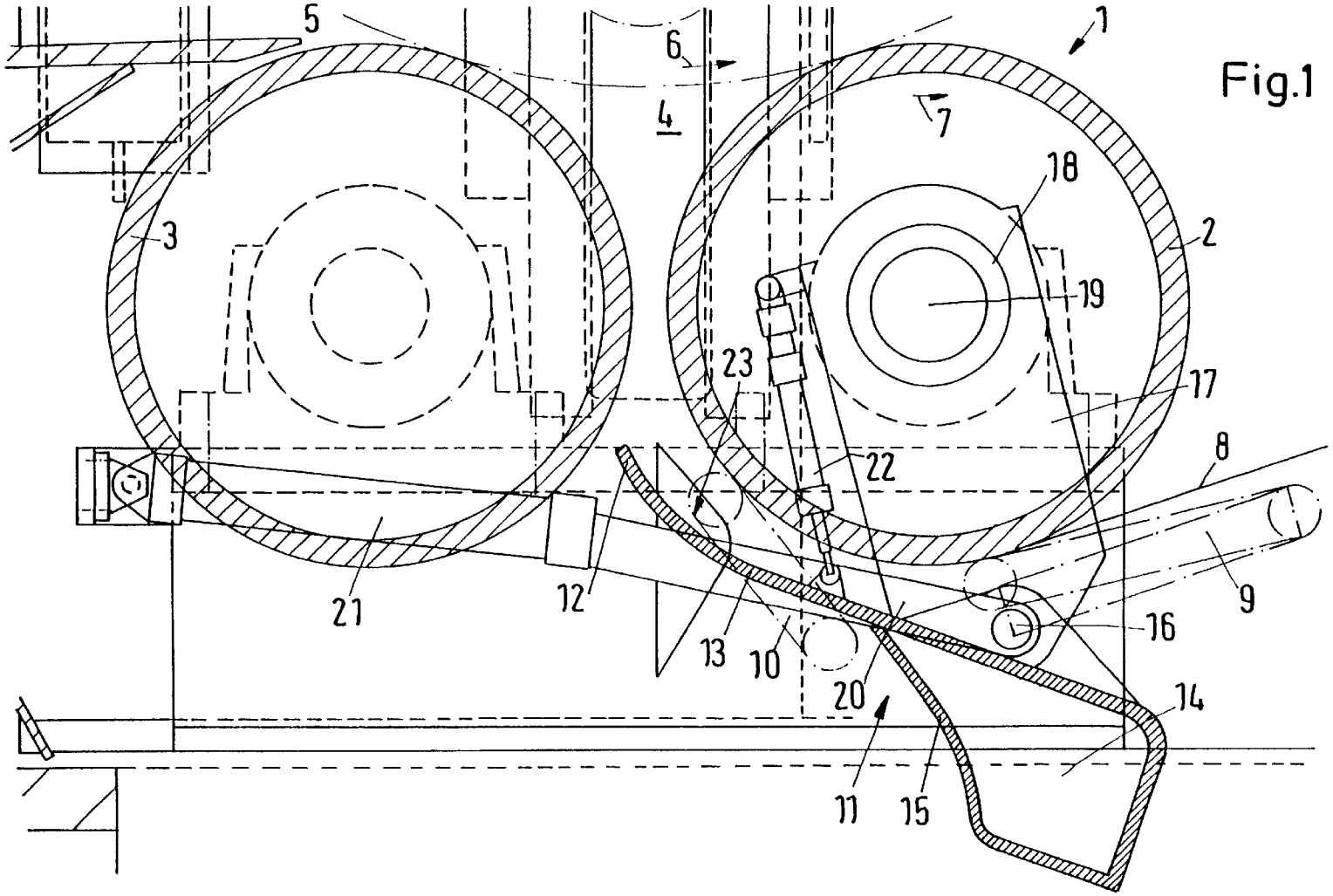
FIG. 1 illustrates a schematic depiction of a reel winding device with the separating device in the normal position.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A reel winding device 1 includes, e.g., a first king roll 2 and a second king roll 3, which form a winding bed 4 in which a wound reel 5 is to be wound. Wound reel 5 is rotatably driven in a direction designated by arrow 6, e.g., by king roll 2 which is driven in a direction shown by arrow 7. By the rotational movement of king roll 2, web 8, which winds around king roll 2 at approximately 180°, is wound onto wound reel 5.

Instead of second king roll 3, another reel support unit can also be utilized, e.g., as a circulating belt guided over two return reels.

Infeed aids 9 and 10, depicted in dashed lines, are provided for guiding the web and to facilitate transport of incoming web 8 into winding bed 4.

Figure 2:
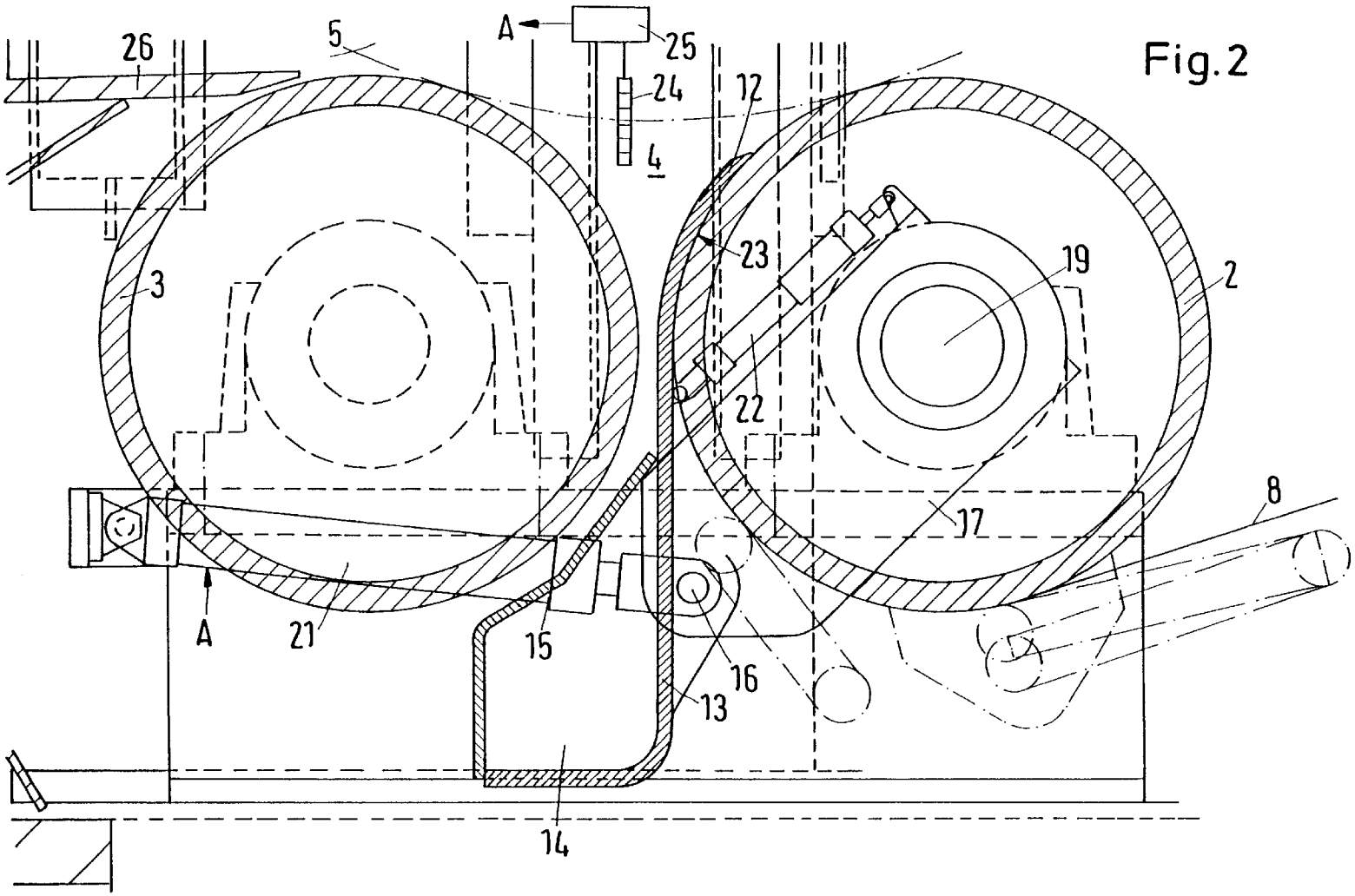
FIG. 2 illustrates the reel winding device with the separating device in the operating position.

A separating device 11, which includes a cutter 12 located at an upper end of a movable cutter holder 13, can be positioned beneath king roll 2. Cutter holder 13 can include a reinforcement profile 14 at its lower end. Further, cutter holder 13 may be bent at its lower end, e.g., by approximately 90°, away from first king roll 2. Reinforcement profile 14 can include a support wall 15 which extends from the unbent lower end of cutter holder 13 to approximately a midpoint of cutter holder 13. As can be seen in FIG. 2, support wall 15 can be concavely bent, so as to follow, at a minimum, an approximate circumference of second king roll 3. Support wall 15 can be welded to cutter holder 13.

Cutter holder 13 is coupled to a support arm 17 in an articulated manner at a pivotable hinge joint 16. Support arm 17 can be, e.g., rotatably coupled to king roll 2 through a bearing 18, or rotatably coupled to a housing that accepts king roll 2. A swivel axis 19 of support arm 17 also corresponds to a rotational axis of king roll 2.

A piston rod 20 of a piston-cylinder unit 21 can also be coupled to hinge joint 16, and the cylinder can be coupled to, e.g., a machine frame (not shown), which also supports king rolls 2 and 3. When piston rod 20 is extended, cutter 12 is located with cutter holder 13 in the normal position, as illustrated in FIG. 1.

When piston-cylinder unit 21 is retracted, support arm 17 is swung through an angle of approximately 60° around swivel axis 19, e.g., in a clock-wise direction, to be positioned in an operating position, as illustrated in FIG. 2.

Auxiliary drive 22 can be fastened to support arm 17 and can be linked to cutter holder 13. With the aid of auxiliary drive 22, the angle between support arm 17 and cutter holder 13 may be altered, i.e., cutter holder 13 can be pivoted relative to support arm 17.

At its connection to cutter 12, cutter holder 13 can include a curved portion or curvature 23 which corresponds to a curvature of a contacting surface of king roll 2. Auxiliary drive 22 contacts cutter holder 13 at approximately the point where curvature 23 makes a transition to a straight segment of cutter holder 13.

A diameter sensor 24, which is schematically depicted in the winding bed (see FIG. 2), can be coupled to a control mechanism which controls piston-cylinder unit 21. Diameter sensor 24 can detect a diameter of the finished wound reel 5 and relay the diameter information to control unit 25. Control unit 25 can then adjust the operating position of cutter 12 in accordance with or as a function of the attained diameter.

Accordingly, separating device 11 operates in the following manner: As is generally known, wound reel 5 is wound until it has reached a predetermined diameter, i.e., until it has accepted a predetermined quantity of web 8. During this winding, separating device 11 remains in its normal position, i.e., piston-cylinder unit 21 and auxiliary drive 22 are extended. In this manner, cutter 12 is positioned a sufficient distance from the surface of king roll 2 so that cutter 12 will not cause any damage to web 8, e.g., a paper or cardboard web, or to the surface of king rolls 2 and 3.

When wound reel 5 has reached its desired diameter, auxiliary drive 22 is activated to draw cutter 12 a distance toward king roll 2, e.g., far enough so that cutter 12 fits through the gap between two king rolls 2 and 3. Piston-cylinder unit 21 is then activated so as to retract piston rod 20, whereby support arm 17 or, more precisely, support arms 17 which are arranged at both axial ends of king roll 2, are turned or rotated around swivel axis by the aforementioned approximately 60°. In this manner, cutter 12 can be pushed through the gap between king rolls 2 and 3. Curvature 23 of cutter holder 13 results in a small distance to the circumferential surface of king roll 2. The motion of cutter holder 13 can be stopped at a specified position which is dependent on the diameter of wound reel 5. At this point, auxiliary drive 22 can be reactivated in order to bring cutter holder 13 flat against king roll 2 and web 8 which is guided over king roll 2. Thus, web 8 is pressed between cutter holder 13 and king roll 2. Reel 5 is then ejected from winding bed 4 by known methods and devices, and forwarded to a rewind table 26. As a result of the ejection motion, web 8 is tensioned over cutter 12. Since the position of cutter 12 can be optimally adjusted for all respective diameters of wound reel 5, the correct cutting angle can be obtained so that web 8 tears off or separates.

Deflection of cutter holder 13 over the length of king rolls 2 and 3 is prevented by three measures: First, curvature 23 of cutter holder 13 results in a certain support; second, auxiliary drive 22 provides supporting contact; and third, support wall 15 provides a supporting effect and, because of its concave shape, is relatively tight against the lower end of winding bed 4.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for winding a web onto a wound reel, comprising:

at least one king roll;

at least one roll support unit;

a winding bed formed by said at least one king roll and said at least one roll support unit;

a separating device comprising a cutter located on a displaceable cutter holder;

support arms being swivelably coupled around a rotational axis of said at least one king roll;

said support arms being coupled to said cutter holder;

a drive coupled to at least one of said support arms; and a control mechanism coupled to said drive to adjust a swivel angel of said cutter holder in accordance with a diameter of the wound reel.

2. The apparatus in accordance with claim 1, wherein said cutter holder is movable between an operating position and a normal position.

3. The apparatus in accordance with claim 1, wherein said cutter holder is coupled to said support arms in an articulated manner, and the apparatus further comprises:

an auxiliary drive arranged to couple at least one of said support arms to said cutter holder, and to angularly adjust said cutter holder relative to said at least one support arm.

4. The apparatus in accordance with claim 1, wherein said cutter holder includes a curved portion having a curvature adapted to match a curvature of a circumference of said king roll.

5. The apparatus in accordance with claim 4, further comprising an auxiliary drive, wherein said auxiliary drive is coupled to said cutter holder in a region of an end of said curved portion.

6. The apparatus in accordance with claim 1, further comprising:

an auxiliary drive coupled to at least one of said support arms; and wherein at least one of said auxiliary drive and said drive comprises a linear drive.

7. The apparatus in accordance with claim 1, wherein said drive is coupled to said at least one support arm at a position at which said cutter holder is coupled to said at least one support arm.

8. The apparatus in accordance with claim 1, wherein said cutter holder comprises a reinforcement profile located at an end opposite from said cutter.

9. The apparatus in accordance with claim 8, wherein said reinforcement profile comprises a support wall positioned to support said cutter holder between said cutter and said at least one support arm.

10. The apparatus in accordance with claim 9, wherein said support wall comprises a concave portion adapted to a contour of said at least one roll support unit.

11. The apparatus in accordance with claim 1, wherein the web is composed of one of a paper and a cardboard web.

12. The apparatus in accordance with claim 1, wherein said at least one roll support unit comprises at least one additional king roll.

13. The apparatus in accordance with claim 1, further comprising a sensor for monitoring the diameter of the wound roll, wherein said sensor is coupled to said control mechanism.

14. An apparatus for winding a web onto a wound reel, comprising:

at least one king roll;

at least one roll support unit;

a winding bed formed by said at least one king roll and said at least one roll support unit;

a separating device comprising a cutter located on a displaceable cutter holder;

support arms being swivelably coupled around a rotational axis of said at least one king roll;

said support arms being coupled to said cutter holder in an articulated manner;

a drive arranged to rotatably displace said cutter holder around said rotational axis of said at least one king roll; and an auxiliary drive arranged to couple at least one of said support arms to said cutter holder, and to rotatably pivot said cutter holder relative to said at least one support arm.

15. The apparatus in accordance with claim 14, wherein said cutter holder includes a curved portion having a curvature adapted to matched to a curvature of a circumference of said king roll, and wherein said auxiliary drive is coupled to said cutter holder in a region of an end of said curved portion.

16. The apparatus in accordance with claim 14, further comprising a control mechanism coupled to said drive to adjust a swivel angle of said cutter holder around said rotational axis of said at least one king roll.

17. The apparatus in accordance with claim 14, wherein at least one of said auxiliary drive and said drive comprises a linear drive.

18. The apparatus in accordance with claim 14, wherein the web is composed of one of a paper and a cardboard web.

19. The apparatus in accordance with claim 14, wherein said at least one roll support unit comprises at least one additional king roll.

20. The apparatus in accordance with claim 14, wherein said cutter holder comprises a reinforcement profile located at an end opposite from said cutter, and a support wall positioned to support said cutter holder between said cutter and said at least one support arm.

21. The apparatus in accordance with claim 20, wherein said support wall comprises a concave portion adapted to a contour of said at least one roll support unit.

22. The apparatus in accordance with claim 14, further comprising a control mechanism coupled to the drive, wherein a swivel angle by which the drive rotates the cutter holder is adjusted by the control mechanism in accordance with a diameter of the wound reel.

23. The apparatus in accordance with claim 22, further comprising a sensor for monitoring the diameter of the wound roll, wherein said sensor is coupled to said control mechanism.

24. A process for separating a web in an apparatus that includes at least one king roll, at least one roll support unit, a winding bed formed by the at least one king roll and the at least one roll support unit, a separating device having a cutter located on a displaceable cutter holder, support arms swivelably coupled around a rotational axis of the at least one king roll and coupled to the cutter holder, a drive coupled to at least one of the support arms, and a control mechanism coupled to the drive, the process comprising:

rotating the at least one king roll, whereby said wind reel is rotatably driven;

moving the cutter toward a gap between the at least one king roll and the at least one roll support unit by rotating the cutter holder around the rotational axis of the at least one king roll with the drive, wherein a swivel angle by which the drive rotates the cutter holder is adjusted by the control mechanism in accordance with a diameter of the wound reel;

pressing, with the cutter holder, the web against an outer circumference of the at least one king roll; and ejecting the reel from the winding bed, whereby the web is separated along the cutter.

25. The process in accordance with claim 24, wherein the rotating of the cutter holder moves the cutter through the gap between the at least one king roll and the at least one roll support unit.

26. The process in accordance with claim 24, wherein the rotating of the cutter holder moves the cutter into a winding bed region.

27. The process in accordance with claim 24, wherein the pressing of the web against the outer circumference of the at least one king roll comprises pivoting the cutter holder relative to the support arms via an auxiliary drive coupled to at least one of the support arms.

28. The process in accordance with claim 27, wherein the apparatus further includes a sensor for monitoring the diameter of the wound roll, and the process further comprises:

monitoring the diameter of the wound roll; and forwarding the diameter information to the control mechanism.

* * * * *